US010950396B2

(12) United States Patent
Takano et al.

(10) Patent No.: US 10,950,396 B2
(45) Date of Patent: Mar. 16, 2021

(54) SWITCH DEVICE HAVING SWINGING-TYPE OPERATION

(71) Applicant: TOYO DENSO KABUSHIKI KAISHA, Minato-ku (JP)

(72) Inventors: Takuya Takano, Kawagoe (JP); Koji Yamazaki, Kawagoe (JP)

(73) Assignee: TOYO DENSO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/724,923

(22) Filed: Dec. 23, 2019

(65) Prior Publication Data

US 2020/0286700 A1 Sep. 10, 2020

(30) Foreign Application Priority Data

Mar. 7, 2019 (JP) ..... JP2019-041773

(51) Int. Cl.
*H01H 21/22* (2006.01)
*H01H 21/04* (2006.01)
*H01H 21/02* (2006.01)

(52) U.S. Cl.
CPC ..... *H01H 21/22* (2013.01); *H01H 21/025* (2013.01); *H01H 21/04* (2013.01); *H01H 2221/08* (2013.01); *H01H 2231/026* (2013.01)

(58) Field of Classification Search
CPC ..... H01H 21/22; H01H 21/025; H01H 21/04; H01H 2221/08; H01H 2231/026
See application file for complete search history.

(56) References Cited

U.S. PATENT DOCUMENTS 5,414,231 A * 5/1995 Sato ..... H01H 15/06 200/1 R
7,183,510 B2 * 2/2007 Ami ..... G05G 25/04 200/302.3
7,294,800 B2 * 11/2007 Koyama ..... H01H 21/08 200/302.1
7,358,453 B2 * 4/2008 Tsunoda ..... H01H 21/08 200/302.1

(Continued)

FOREIGN PATENT DOCUMENTS

JP 2016-134350 7/2016

OTHER PUBLICATIONS

JP 2016-134350, Yuki et al., machine translation. (Year: 2016).*

*Primary Examiner* — Kyung S Lee
(74) *Attorney, Agent, or Firm* — Cozen O'Connor

(57) ABSTRACT

A switch device which is capable of ensuring mounting strength of an additional member while ensuring ease of operation. The switch device has an operating knob that transmits an input operation to a switch unit with an electric contact, and a housing that houses a switch unit. The housing that houses the switch unit has an opening via which the switch unit and the operating knob face each other. The housing has a water prevention wall installed in a standing manner to surround the opening. The operating knob has a box-shaped base member with one end thereof opened. An additional member with at least one insertion portion which is inserted into a through hole of the base member is mounted on the base member. The insertion portion extends to cross a standing direction of the water prevention wall, and as seen in the standing direction, the insertion portion and the opening are located away from each other.

7 Claims, 7 Drawing Sheets

(56) References Cited

U.S. PATENT DOCUMENTS

| | | | | |
|---|---|---|---|---|
| 8,698,017 | B2 * | 4/2014 | Mizukoshi | H01H 23/06<br>200/5 A |
| 9,336,972 | B2 * | 5/2016 | Hisada | H01H 23/24 |
| 2004/0074747 | A1 * | 4/2004 | Komatsu | H01H 21/22<br>200/176 |
| 2006/0175185 | A1 * | 8/2006 | Shimizu | H01H 23/06<br>200/302.1 |
| 2016/0268075 | A1 * | 9/2016 | Yamaguchi | H01H 23/30 |

* cited by examiner

SWITCH DEVICE HAVING SWINGING-TYPE OPERATION

BACKGROUND OF THE INVENTION

Field of the Invention

The present invention relates to a switch device that is swung by an operator's fingertip.

Description of the Related Art

A switch device that is swung by an operator's fingertip is used for vehicles and various types of electronic equipment. For example, as shown in FIG. 7A, a switch device 70 for activating or inactivating a power window apparatus for a vehicle has a board 72 on which a light source 71 is mounted, a housing 73 that houses the board 72 and also forms an outer shell of the switch device 70, and an operating knob 74 that is configured to be capable of being swung up and down (see, for example, Japanese Laid-Open Patent Publication No. 2016-134350).

In the switch device 70, an input operation is transmitted to a driving member of a switch unit (not shown) provided on the board 72 by the operator putting his or her finger on a concave finger rest 75 provided on a front side face of the operating knob 74 and swinging the operating knob 74. The switch unit then converts the input operation into an electric signal. The electric signal is transmitted to an ECU, which in turn transmits an operation signal to the power window apparatus.

The switch device 70 is usually provided on an elbow rest inside a vehicle door, and a member for improving the appearance of the operating knob 74 such as a metal-plated decorating member 76 is provided on a base member 77 formed of a synthetic resin and constituting an outer shape of the operating knob 74.

The base member 77 is comprised of a box with its bottom opened and houses a water prevention wall 79 that is installed in a standing manner to surround a rectangular opening 78 formed in an upper surface of the housing 73. It should be noted that the base member 77 is pivotally supported by a shaft 80 provided in an upper portion of the water prevention wall 79 so that the operating knob 74 can be swung.

The decorating member 76 is placed on an upper front side of the base member 77 so that it can easily be seen or noticed. The decorating member 76 having a bifurcated insertion portion 81 is mounted on the base member 77 by inserting the insertion portion 81 into through holes 82 formed in an upper front portion of the base member 77 and stopping it in a state of being engaged with an inner surface of the finger rest 75 of the base member 77.

In the case where the switch device 70 is provided in the elbow rest inside the door as described above, rainwater may fall onto the switch device 70. In this case, the rainwater going on the insertion portion 81 of the decorating member 76 may enter the base member 77 and drop to the switch unit provided on the board 72 through the opening 78 of the housing 73.

To address this problem, in the switch device 70 described in Japanese Laid-Open Patent Publication No. 2016-134350, the insertion portion 81 is placed in a space S between an outer side of the water prevention wall 79, which surrounds the opening 78, and the finger rest 75 as seen in a plan view from above so that the rainwater moving on the insertion portion 81 can be guided to the outside of the water prevention wall 79 so as to prevent the rainwater from entering the housing 73 through the opening 78.

In the switch device 70 described in Japanese Laid-Open Patent Publication No. 2016-134350, however, since the insertion portion 81 of the decorating member 76 is provided in the space S between an outer side of the water prevention wall 79 and the finger rest 75 of the operating knob 74 (the base member 77), the finger rest 75 cannot be concaved rearward to a sufficient level, and hence it is difficult for the operator to firmly put his or her fingertip on the finger rest 75. As a result, ease of operation of the operating knob 74 may become worse.

If the finger rest 75 is concaved rearward to a sufficient level so as to improve ease of operation of the operating knob 74, enough space S for installing the insertion portion 81 cannot be secured between the finger rest 75 and the outer side of the water prevention wall 79. For this reason, there is no other choice but to reduce the length of the insertion portion 81. However, a part of the insertion portion 81 which is stopped in a state of being engaged with the inner side of the finger rest 75 cannot be large, and hence the decorating member 76 cannot be mounted on the base member 77 with sufficient strength. Therefore, the decorating member 76 may fall off while the operating knob 74 is being swung.

Moreover, to provide the enough space S between the finger rest 75 and the outer side of the water prevention wall 79 so as to mount the decorating member 76 on the base member 77 with sufficient strength while keeping the finger rest 75 concaved rearward to the sufficient level, it is necessary to set the water prevention wall 79 back as shown in FIG. 7C, and accordingly, the opening 78 needs to be narrowed. Here, the light source 71 on the board 72 illuminates a fluorescent member 83, which is provided on an upper surface of the operating knob 74 (the base member 77), through the opening 78, and if the opening 78 is narrowed, flexibility in placement of the light source 71, and by extension, flexibility in placement of the translucent member 83 will decrease, which may lead to a poor design of the switch device 70.

SUMMARY OF THE INVENTION

The present invention provides a switch device which is capable of ensuring mounting strength of an additional member while ensuring ease of operation.

Accordingly, the present invention provides A switch device comprising an operating knob that transmits an input operation to a switch unit having an electric contact; and a housing that houses the switch unit, wherein the housing has an opening via which the switch unit and the operating knob face each other, and a water prevention wall that is installed in a standing manner to surround the opening, the operating knob is comprised of a box-shaped base member with one end thereof opened, and an additional member that is mounted on the base member, the additional member has at least one projecting insertion portion, the base member has a through hole into which the insertion portion is inserted and houses the water prevention wall, and the insertion portion is extended to cross a standing direction of the water prevention wall, and as seen in the standing direction of the water prevention wall, the insertion portion and the opening are located away from each other.

According to the present invention, since the insertion portion of the additional member extends in such a manner as to cross the standing direction of the water prevention wall, the insertion portion is not located between the finger rest of the operating knob and the outer side of the water prevention wall. This eliminates the necessity for securing enough space between the finger rest of the operating knob and the outer side of the water prevention wall and therefore makes it possible to increase the size of a concave in the finger rest. As a result, ease of operation of the operating knob is ensured. Moreover, since it is unnecessary to consider interference of the insertion portion with the finger rest, the necessity for reducing the length of the insertion portion is eliminated, making it possible to increase the amount by which the insertion portion is engaged with the inner surface of the base member. As a result, mounting strength of the additional member is ensured.

Further features of the present invention will become apparent from the following description of exemplary embodiments (with reference to the attached drawings).

DESCRIPTION OF THE EMBODIMENTS

An embodiment of the present invention will now be described in detail with reference to the drawings.

Figure 1:
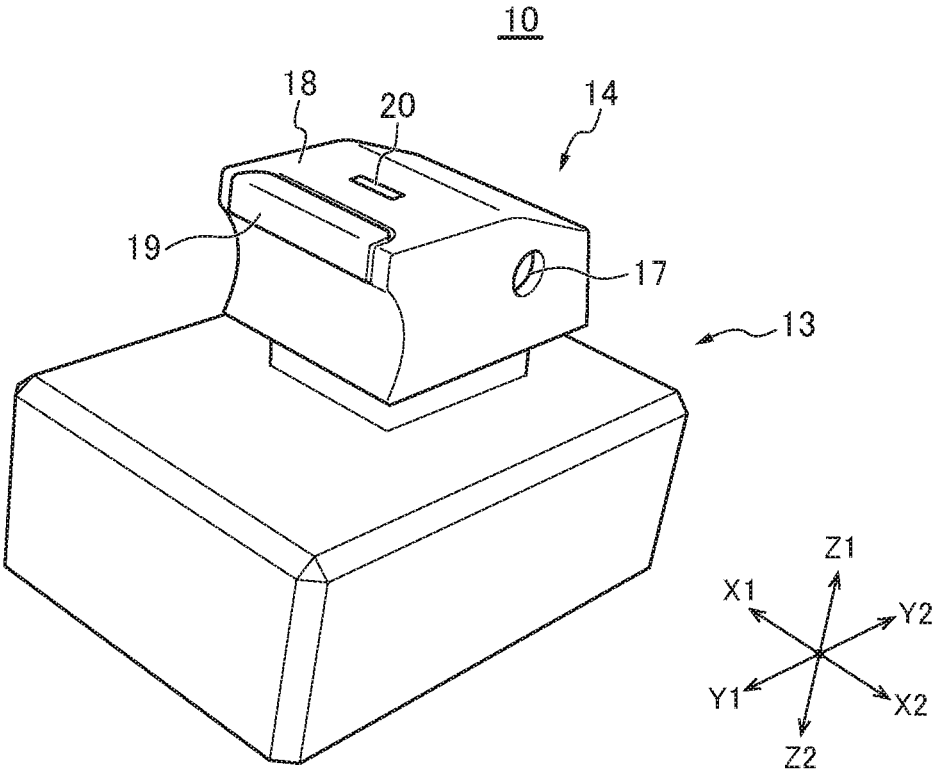
FIG. 1 is a perspective view of a switch device according to an embodiment of the present invention.
Figure 2:
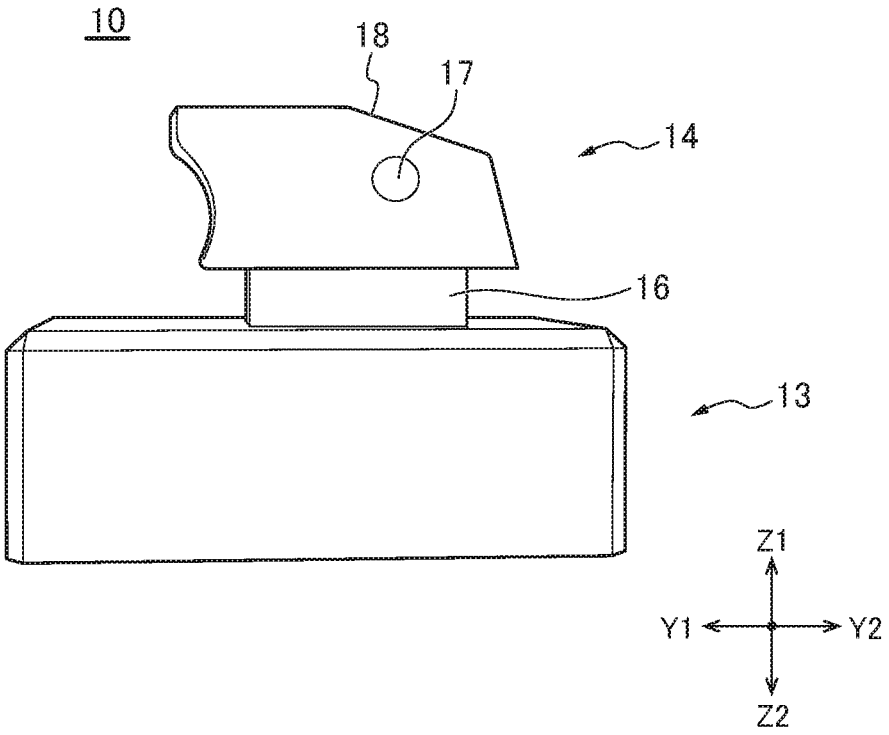
FIG. 2 is a side view of the switch device according to the embodiment of the present invention.
Figure 3:
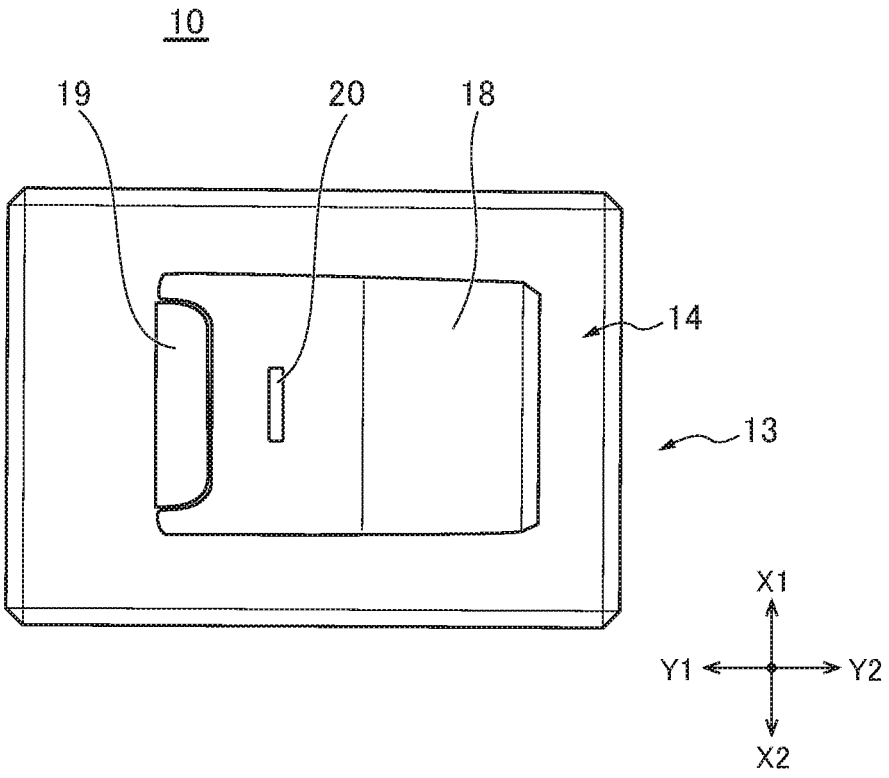
FIG. 3 is a plan view of the switch device according to the embodiment of the present invention.
Figure 4A:
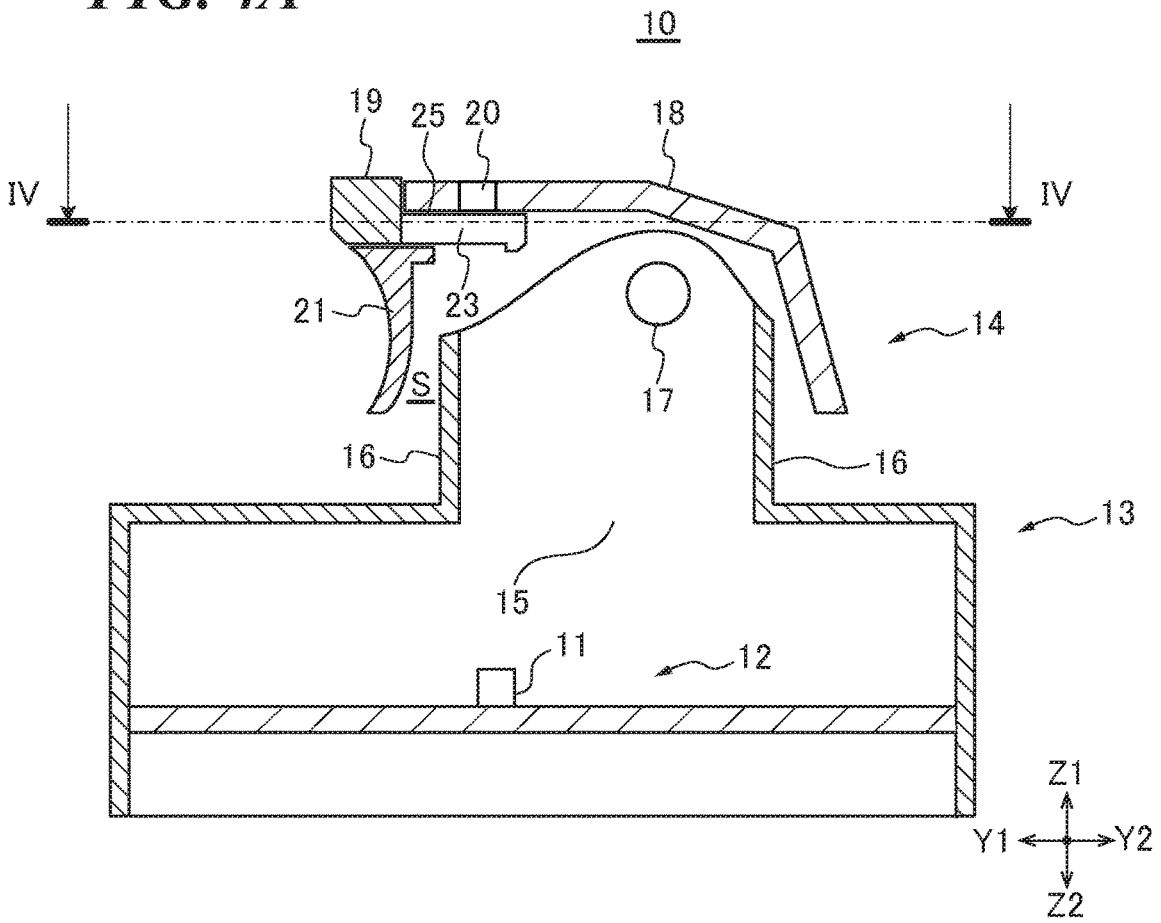
FIGS. 4A and 4B are cross-sectional views of the switch device according to the embodiment of the present invention.
Figure 4B:
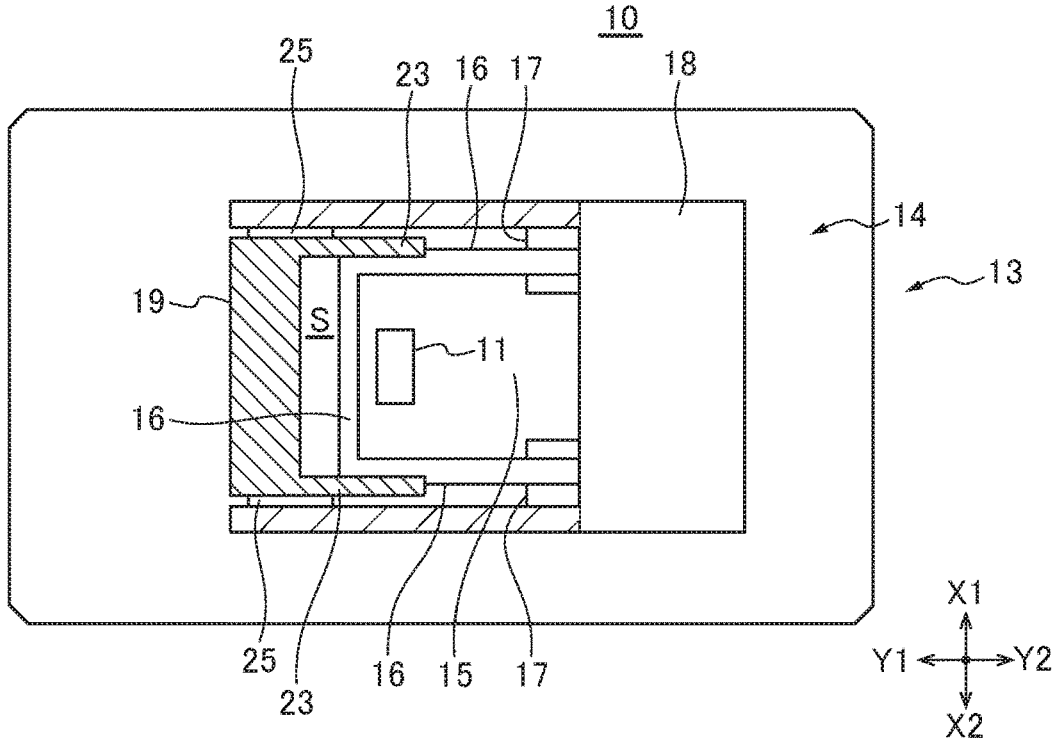

FIG. 1 is a perspective view of a switch device according to an embodiment of the present invention. FIG. 2 is a side view of the switch device according to the present embodiment. FIG. 3 is a plan view of the switch device according to the present embodiment. FIGS. 4A and 4B are cross-sectional views of the switch device according to the embodiment of the present invention. FIG. 4A shows a longitudinal cross section, and FIG. 4B shows a cross section taken along line IV-IV in FIG. 4A. In each figure, a direction X1 is referred to as right; a direction X2, left; a direction Y1, front; a direction Y2, rear; a direction Z1, upper; and a direction Z2, lower for ease of explanation.

Referring to FIGS. 1 to 4B, the switch device 10 for activating or inactivating a power window apparatus for a vehicle has a board 12 on which an LED light source 11 (light emitting unit) and a switch unit (not shown) with an electric contact are mounted, a box-shaped housing 13 constituting a major portion of an outer shape of the switch device 10, and an operating knob 14 configured to be capable of being swung. The housing 13 houses the board 12, and the operating knob 14 is placed above the housing 13. It should be noted that the switch unit should not always be an ordinary one which takes the form of a unit equipped with a driving member such as a lever, but may be one which does not take the form of a unit and is comprised only of a fixed contact and a movable contact or one which has a rubber contact.

The housing 13 has a rectangular opening 15 formed in its upper surface. As the housing 13 is seen in the direction Z2, the LED light source 11 and the switch unit are exposed from the opening 15. The housing 13 has a water prevention wall 16 which is raised upward from an upper surface of the housing 13 in such a manner as to surround the opening 15. A columnar rotary shaft 17 projecting horizontally is provided in an upper part of the water prevention wall 16 to pivotally support the operating knob 14. Thus, the operating knob 14 is mounted on the water prevention wall 16 (the housing 13) such that it is capable of vertically rocking about the rotary shaft 17.

The operating knob 14 is comprised of a base member 18 constituting a major portion of an outer shape of the operating knob 14, and a decorating member 19 (an additional member) mounted on the base member 18. The base member 18 is comprised of a box whose lower portion comprised of an object formed of synthetic resin is opened, and the decorating member 19 is comprised of a body formed of, for example, a metal-plated synthetic resin for an aesthetic purpose and is placed in an upper front side of the base member 18 so that it can easily be seen or noticed.

The base member 18 of the operating knob 14 is placed above the housing 13 so as to house the water prevention wall 16. Accordingly, the base member 18 is placed so as to face the LED light source 11 and the switch unit via the opening 15. The base member 18 has a translucent member 20 that is placed to so as to penetrate an upper surface of the base member 18. As the operating knob 14 is seen in the direction Z2, the translucent member 20 substantially faces the LED light source 11, which is exposed from the housing 13, via the opening 15. As a result, light emitted from the LED light source 11 passes through the translucent member 20 to make the translucent member 20 look like as if it were emitting light by itself, and therefore, for example, can inform an operator of a position of the operating knob 14 during the night. It should be noted that the design of the switch device 10 can be improved by coloring the translucent member 20 in a desired color or changing a color of light emitted by the LED light source 11 to a desired color. The design of the switch device 10 can be further improved by devising a shape of the translucent member 20, and for example, the translucent member 20 may be shaped like a desired letter or symbol which informs the operator about a function of the switch device 10.

In the switch device 10, since the operating knob 14 swings only in a vertical direction, the translucent member 20 does not widely move from side to side or back and forth. As a result, even when the operating knob 14 swings, the translucent member 20 still substantially faces the LED light source 11. Therefore, the quantity of light passing through the translucent member 20 does not change greatly, and hence the operator who is seeing the switch device 10 feels quite normal.

The base member 18 of the operating knob 14 also has a concave finger rest 21 that is curved rearward on a front side face of the base member 18. In the switch device 10, the operator swings the operating knob 14 by resting his or her finger on the finger rest 21 to transmit an input operation to a driving member of the switch unit (not shown) provided on the board 12. The switch unit converts the input operation into an electric signal, which in turn is transmitted to an ECU. The ECU then transmits an operating signal to the power window apparatus.

Figure 5A:
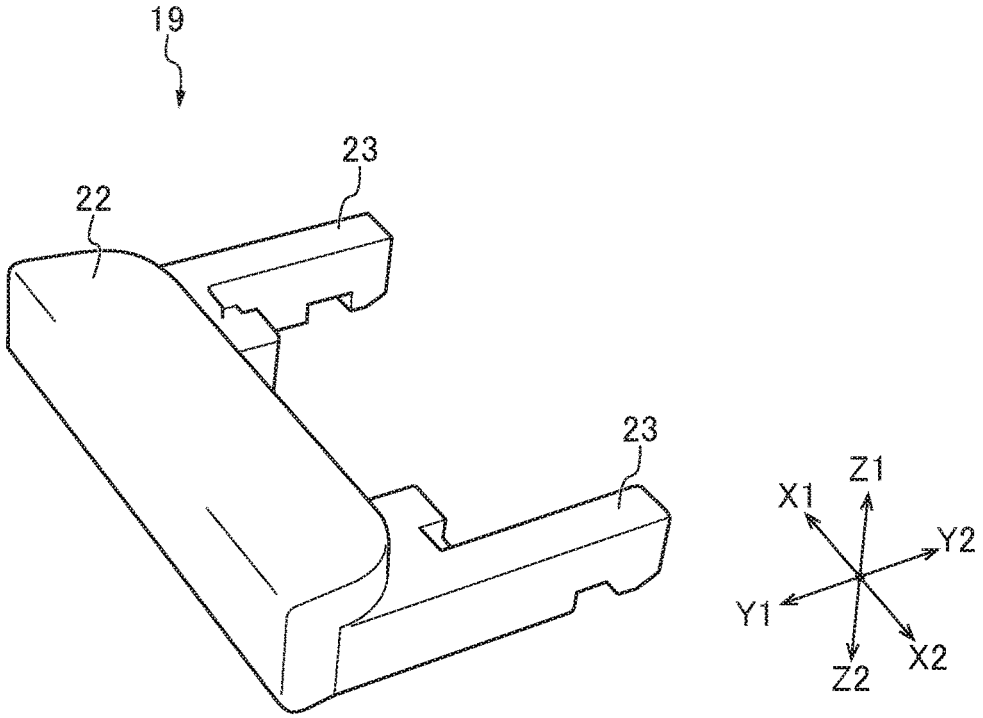
FIGS. 5A and 5B are perspective views schematically showing an arrangement of a decorating member of an operating knob appearing in FIGS. 1, 4A, and 4B.
Figure 5B:
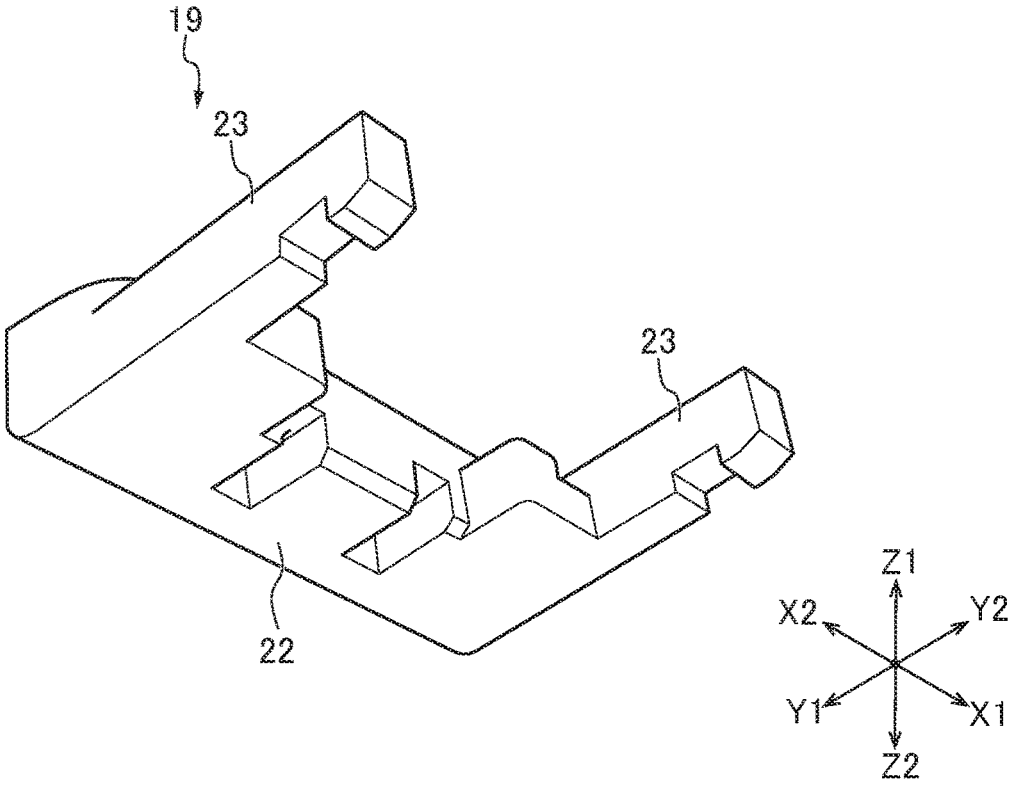
Figure 6A:
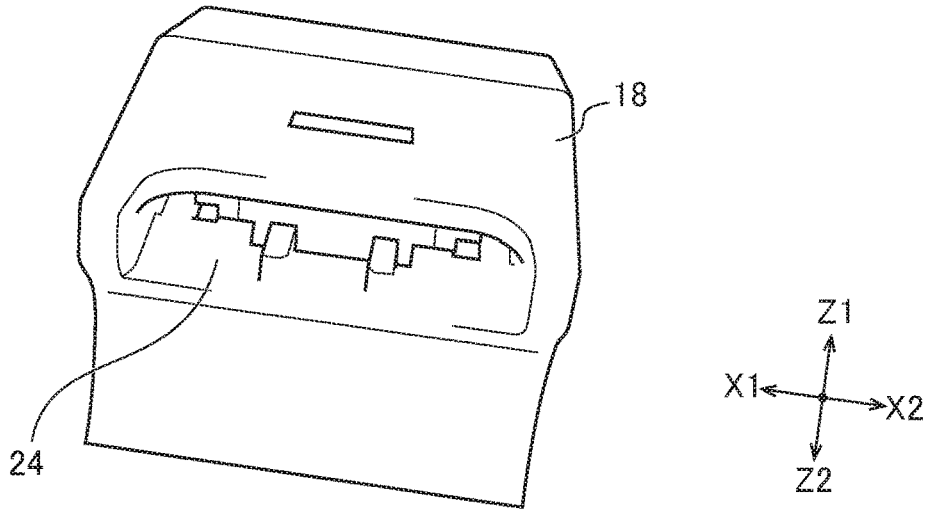
FIGS. 6A to 6C are perspective views schematically showing an arrangement of a base member of the operating knob appearing in FIGS. 1 to 4B.
Figure 6B:
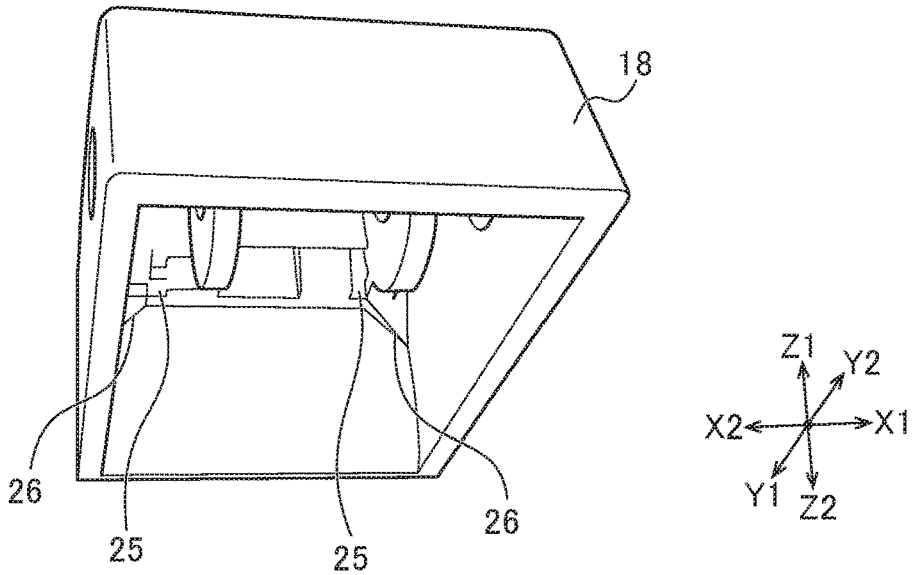
Figure 6C:
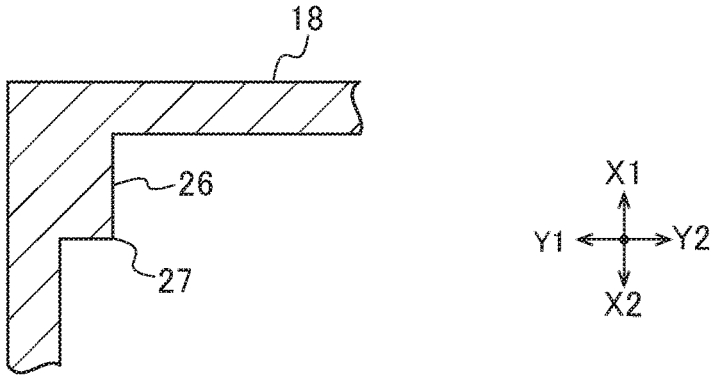
Figure 7A:
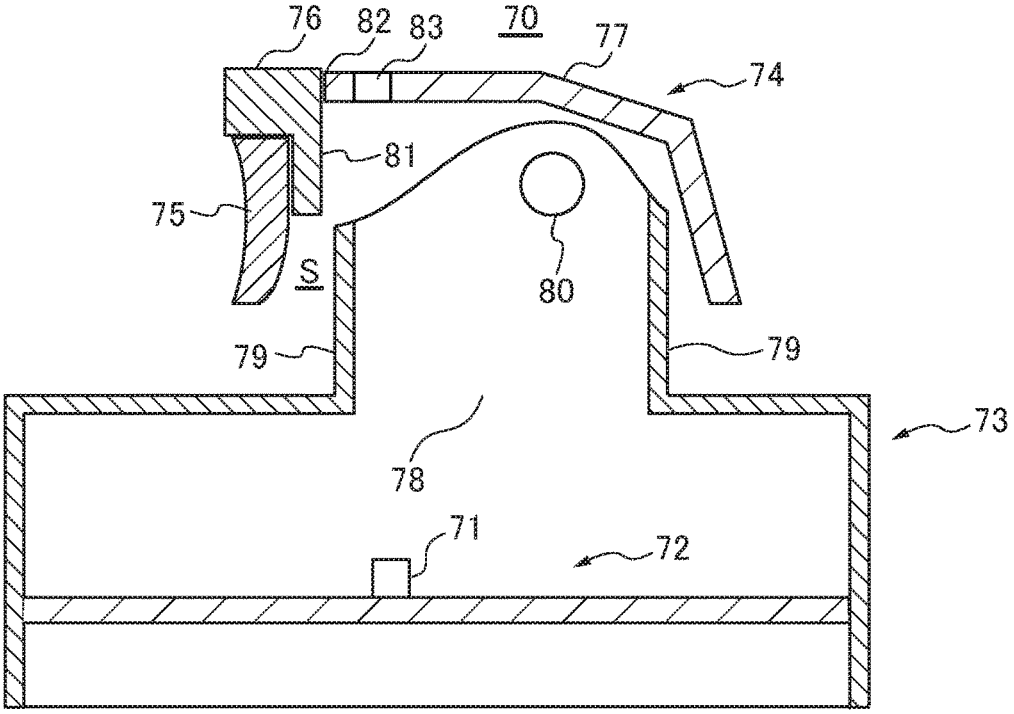
FIGS. 7A, 7B, and 7C are cross-sectional views of a conventional switch device.
Figure 7B:
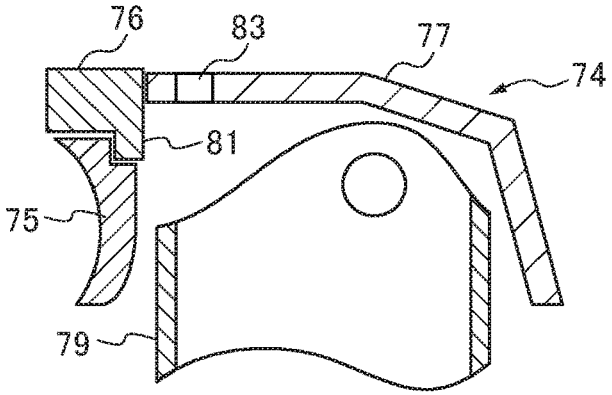
Figure 7C:
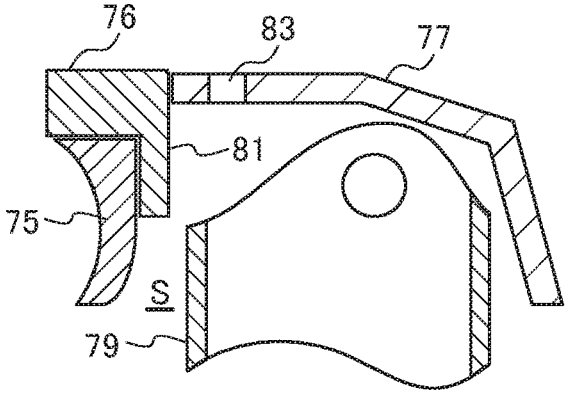

FIGS. 5A and 5B are perspective views schematically showing an arrangement of the decorating member of the operating knob appearing in FIGS. 1, 4A, and 4B. FIG. 5A shows a state in which the decorating member is seen from the front and diagonally above, and FIG. 5B shows a state in which the decorating member is seen from the rear and diagonally below. FIGS. 6A, 6B, and 6C are perspective views schematically showing an arrangement of the base member of the operating knob appearing in FIGS. 1 to 4B. FIG. 6A shows a state in which the base member is seen from the front and diagonally above, FIG. 6B shows a state in which the base member is seen from the rear and diagonally below, and FIG. 6B shows a partial cross section of a corner portion of the base member in the direction X1 and the direction Y1.

Referring first to FIGS. 5A and 5B, the decorating member 19 has a base portion 22 comprised of a substantially columnar members extending laterally, and a pair of rod-shaped insertion portions 23 projecting rearward from both ends of the base portion 22, which are located in a lateral direction of the base portion 22. Referring to FIGS. 6A, 6B, and 6C, the base member 18 has an engaging concave portion 24 which is a concave formed in an upper front part of the base member 18, and two through holes 25 passing through an interior of the base member 18 from the engaging concave portion 24. The engaging concave portion 24 is a concave extending laterally and is a little larger than the base portion 22 of the decorating member 19. The decorating member 19 is mounted on the base member 18 by fitting the base portion 22 into the engaging concave portion 24. When the base portion 22 is fitted into the engaging concave portion 24, the inserting portions 23 are inserted into the respective through holes 25. Rear ends of the respective inserting portions 23 are molded like hooks, and when they are inserted into the through holes 25, the rear ends are stopped in a state of being engaged with engagement portions (not shown) provided inside the base member 18.

When the decorating member 19 is mounted on the base member 18, the insertion portions 23 inserted into the respective through holes 25 extend in such a manner as to cross the standing direction of the water prevention wall 16 (the direction Z1 in the present embodiment), for example, in a direction perpendicular to the direction Z1 (FIG. 4A). In this state, as seen in the direction Z2, none of the insertion portions 23 covers the opening 15, and the insertion portions 23 and the opening 15 are away from each other, but at least a part of the insertion portions 23 overlaps the water prevention wall 16 (FIG. 4B).

It should be noted that although it has been described that the insertion portions 23 extend in such a manner as to cross the standing direction of the water prevention wall 16, it can be said that in the present embodiment, the insertion portions 23 extend along the upper surface of the base member 18 or extend substantially parallel to the board 12 placed in the front-back direction. The direction in which the insertion portions 23 extend should not always be the direction perpendicular to the direction Z1, but may be any direction as long as it is not a direction toward a space S between a front outer side of the water prevention wall 16 and the finger rest 21.

If the switch device 10 is provided in an elbow rest inside a vehicle door, rainwater may go through spaces between the through holes 25 and the insertion portions 23, and further move on the insertion portions 23 to enter the base member 18. As described above, however, since the insertion portions 23 and the opening 15 are located away from each other as seen in the direction Z2, the rainwater moving on the insertion portions 23 never drops toward the opening 15. This prevents the LED light source 11 and the switch unit housed in the housing 13 from being covered with rainwater that has entered the housing 13 via the opening 15. Moreover, since the insertion portions 23 do not cover the opening 15, they never block light emitted by the LED light source 11, and hence a desired amount of light emission can be secured in the translucent member 20.

Furthermore, as shown in FIG. 6B, the base member 18 has guide ribs 26 which are provided at inside corners in a manner extending from the through holes 25 toward an opening (downward) of the base member 18. The guide ribs 26 are placed along inner sides of side walls of the base member 18, and they have respective edge portions 27 in their cross sections in the directions X1 and Y1 (FIG. 6C). The cross sections of the guide ribs 26 decrease as they go downward from the through holes 25. Namely, the guide ribs 26 are shaped like an inverted pyramid that becomes narrower as it goes downward.

Of rainwater that has entered the base member 18 through the spaces between the through holes 25 and the insertion portions 23, rainwater that has not moved on the insertion portions 23 is guided toward the opening of the base member 18 (downward) through the guide ribs 26. Particularly because water tends to be concentrated in a tapered area, the above rainwater is concentrated at the edges 27 of the guide ribs 26, and as a result, the guide ribs 26 reliably guide the rainwater to the opening of the base member 18 (downward). This also reliably prevents the rainwater from dropping to the opening 15.

In the switch device 10 described above, since the insertion portions 23 of the decorating member 19 extend in such a manner as to cross the standing direction (the direction Z1) of the water prevention wall 16, the insertion portions 23 are not located between the finger rest 21 of the operating knob 14 and the outer side of the water prevention wall 16. This eliminates the necessity for securing enough space S between the finger rest 21 and the outer side of the water prevention wall 16, and hence it is possible to make a concave of the finger rest 21 larger. As a result, ease of operation of the operating knob 14 is ensured. Moreover, the necessity for considering interference of the insertion portions 23 with the finger rest 21 is eliminated, and hence it is unnecessary to reduce the length of the insertion portions 23. This makes it possible to secure sufficient amount by which the insertion portions 23 are engaged with the base member 18. As a result, mounting strength of the decorating member 19 is ensured to prevent the decorating member 19 from falling off even when the operating knob 14 is swung.

Moreover, in the switch device 10, the insertion portions 23 overlap the water prevention wall 16 as seen in the direction Z2, there is no need to laterally increase the size of the base member 18 for the purpose of avoiding its interference with the insertion portions 23, and as a result, the switch device 10 is downsized.

Furthermore, in the switch device 10, since the guide ribs 26 are provided at the inside corners of the base member 18 and along the side walls of the base member 18, stiffness of the base member 18 is increased. As a result, even when the base member 18 is subjected to an excessive force due to swinging of the operating knob 14, the base member 18 is prevented from becoming deformed or damaged.

Although the present invention has been described by way of the preferred embodiment, the present invention should not be limited to the embodiment described above, but various modifications and alterations can be made without departing from the spirit of the prevent invention.

For example, although the decorating member 19 has the pair of insertion portions 23, the decorating member 19 may have only one insertion portion 23 as long as adequate strength of the decorating member 19 when it is mounted on the base member 18 can be ensured, and in this case, the decorating member 19 may be stopped in a state of being engaged with the inner side face of the base member 18 with the one insertion portion 23.

Moreover, a touch feel adding member which adds a preferable touch feel to an operator's fingertip may be placed in the upper front portion of the base member 18 instead of the decorating member 19. In this case, as with the decorating member 19, the touch feel adding member is equipped with a pair of insertion portions which are inserted into the respective through holes 25 of the base member 18 so that the touch feel adding member can be mounted on the base member 18. It should be noted that the touch feel adding member is made of, for example, a soft resin or hard rubber.

Furthermore, although in the switch device 10, the insertion portions 23 partially overlap the water prevention wall 16 as seen in the direction Z2, the spaces between the insertion portions 23 may be widened horizontally so that they do not overlap the water prevention wall 16 if the necessity for downsizing the switch device 10 is not so great. This reliably prevents rainwater moving on the insertion portions 23 from dropping to the opening 15 surrounded by the water prevention wall 16.

In addition, although the decorating member 19 is formed of the metal-plated synthetic resin, it may be formed of a colored resin, synthetic resin or metal coated with paint, or only metal such as aluminum. Although the finger rest 21 of the base member 18 is concaved by curving it backward, a concave comprising a plurality of slopes may be formed in the finger rest 21 as long as a fingertip can properly catch it. Furthermore, although the rotary shaft 17 of the water prevention wall 16 has a columnar shape, it may be formed in conical form as long as it can pivotally support the operating knob 14.

Moreover, although in the embodiment described above, the switch unit transmits an operation signal to the power window apparatus via the ECU, the switch unit may directly transmit an operation signal to the power window apparatus.

It should be noted that although in the above description of the embodiment, the present invention is applied to the switch device for activating or inactivating the power window apparatus for a vehicle, the present invention may be applied to, for example, a switch device for releasing a parking brake apparatus for a vehicle, a roof switch for opening and closing a sunroof or a roof itself, a trunk opener for opening and closing a trunk, and a shift switch for use in a shifting operation. The present invention may also be applied to switch devices for electronic equipment other than vehicles.

Furthermore, the switch device 10 has the LED light source 11 and the translucent member 20, and light passing through the translucent member 20 informs the operator of a position of the operating knob 14, but for example, the base member 18 may be formed of a white resin painted with black paint, and then the black paint may be partially removed by laser machining to form a predetermined symbol or letter. In this case, light is caused to pass through the white resin of the predetermined symbol or letter to inform the operator of a position of the operating knob 14. Alternatively, instead of the translucent member 20, a predetermined symbol or letter may be drawn on the operating knob 14 with fluorescent paint which glows to inform the operator of a position of the operating knob 14. In this case, the LED light source 11 and the translucent member 20 can be dispensed with.

This application claims the benefit of Japanese Patent Application No. 2019-041773, filed on Mar. 7, 2019 which is hereby incorporated by reference herein in its entirety.

What is claimed is:

1. A switch device comprising:

an operating knob configured to transmit an input operation to a switch unit having an electric contact; and a housing configured to house the switch unit, wherein the housing comprises an opening via which the switch unit and the operating knob face each other, and a water prevention wall that is installed in a standing manner to surround the opening, the operating knob comprises a box-shaped base member having one end thereof opened, and an additional member that is mounted on the base member, the additional member comprises at least one projecting insertion portion, the base member comprises a through hole into which the insertion portion is inserted, and houses the water prevention wall, the insertion portion is extended to cross a standing direction of the water prevention wall, and as seen in the standing direction of the water prevention wall, the insertion portion and the opening are located away from each other, and as seen in the standing direction of the water prevention wall, at least a part of the insertion portion overlaps the water prevention wall.

2. The switch device according to claim 1, wherein the base member is installed in a manner extending from the through hole along an inner side of a side wall of the base member and comprises a rib that extends toward the one end.

3. The switch device according to claim 2, wherein the rib is provided at an inner corner of the base member.

4. The switch device according to claim 2, wherein the rib has an edge portion in a cross section that crosses an extending direction of the rib.

5. The switch device according to claim 1, wherein the housing incorporates a light emitting unit, and the light emitting unit faces the operating knob via the opening.

6. The switch device according to claim 1, wherein the additional member is a decorating member.

7. The switch device according to claim 1, wherein the additional member is a touch-feel adding member.

* * * * *